US008864177B2

(12) United States Patent
Cenzano et al.

(10) Patent No.: US 8,864,177 B2
(45) Date of Patent: Oct. 21, 2014

(54) MOVABLE HIGHLIGHT STRIP

(71) Applicant: Esselte Corporation, Melville, NY (US)

(72) Inventors: Lauren Cenzano, N. Babylon, NY (US); Denise Ceron, Syosset, NY (US); Patty Dyer, Livermore, CA (US); Meryl Altuch, Port Washington, NY (US); Lisa Duff, Patchogue, NY (US)

(73) Assignee: Esselte Corporation, Melville, NY (US)

( * ) Notice: Subject to any disclaimer, the term of this patent is extended or adjusted under 35 U.S.C. 154(b) by 0 days.

(21) Appl. No.: 13/681,936

(22) Filed: Nov. 20, 2012

(65) Prior Publication Data

US 2013/0127148 A1 May 23, 2013

Related U.S. Application Data

(60) Provisional application No. 61/563,352, filed on Nov. 23, 2011.

(51) Int. Cl.

| | |
|---|---|
| ***B42D 3/00*** | (2006.01) |
| ***B42D 19/00*** | (2006.01) |
| ***B42D 5/00*** | (2006.01) |
| ***B42F 13/40*** | (2006.01) |
| ***B42D 9/00*** | (2006.01) |

(52) U.S. Cl.

CPC ..... *B42D 19/00* (2013.01); *B42D 5/006* (2013.01); *B42F 13/40* (2013.01); *B42D 9/002* (2013.01); *B42D 9/008* (2013.01)

USPC ..... 281/44; 281/42

(58) Field of Classification Search

CPC ..... B42D 5/003; B42D 5/005

USPC ..... 281/44, 42; 402/57

See application file for complete search history.

(56) References Cited

U.S. PATENT DOCUMENTS

| | | | |
|---|---|---|---|
| 241,716 | A | 5/1881 | Plummer |
| 724,320 | A | 3/1903 | McGregor |
| 1,614,838 | A | 1/1927 | Gorin |
| 1,747,659 | A | 2/1930 | Bottle |
| 2,051,551 | A | 8/1936 | Evans |
| 3,116,738 | A | 1/1964 | Wentges |
| 3,612,709 | A | 10/1971 | Miyamoto |
| 4,175,777 | A | 11/1979 | Horn |
| 4,307,972 | A | 12/1981 | Errichiello |
| 4,637,149 | A | 1/1987 | Rivkin |
| 4,878,776 | A | 11/1989 | Orlandini |

(Continued)

FOREIGN PATENT DOCUMENTS

| | | |
|---|---|---|
| CN | 1480103 | 3/2004 |
| CN | 1561925 | 1/2005 |

(Continued)

*Primary Examiner* — Kyle Grabowski

(74) *Attorney, Agent, or Firm* — Dorsey & Whitney LLP

(57) ABSTRACT

A highlighter strip including adhesive to form a removable bond with a substrate, constructed from a translucent and colored material. The highlighter strip can be affixed over writing or other markings, which highlights the indicia that remains legible. One or both ends of the strip can omit the adhesive, thereby providing a grabbing portion to facilitate removal from an initial position and optionally subsequent positions. The strip can be included in a set of strips affixed to each other and optionally affixed to another base; such as a notebook, binder, or other entity where one would expect writing, text, or other indicia requiring highlighting.

22 Claims, 10 Drawing Sheets

(56) References Cited

U.S. PATENT DOCUMENTS

| | | | | |
|---|---|---|---|---|
| 4,898,115 | A | 2/1990 | Bowlay-Williams | |
| 4,970,984 | A | 11/1990 | Vazquez | |
| 5,098,817 | A * | 3/1992 | Voorhees | 430/396 |
| 5,248,280 | A | 9/1993 | Lockwood et al. | |
| 5,283,091 | A | 2/1994 | Darvell et al. | |
| 5,697,518 | A * | 12/1997 | Callahan, Jr. | 221/34 |
| 5,707,482 | A * | 1/1998 | Fusselman | 156/577 |
| 6,213,517 | B1 | 4/2001 | Goluszka et al. | |
| 6,217,443 | B1 | 4/2001 | Green, Jr. | |
| 6,357,797 | B1 | 3/2002 | Lee | |
| 7,416,356 | B2 | 8/2008 | Quilantan | |
| 7,708,487 | B2 | 5/2010 | Leibman | |
| 2003/0178837 | A1 | 9/2003 | Ung et al. | |
| 2005/0142308 | A1 * | 6/2005 | Thorpe | 428/34.1 |
| 2005/0206154 | A1 * | 9/2005 | Walker et al. | 281/24 |
| 2006/0269352 | A1 * | 11/2006 | Hite | 401/131 |
| 2008/0061547 | A1 * | 3/2008 | Jour | 281/44 |

FOREIGN PATENT DOCUMENTS

| | | |
|---|---|---|
| CN | 1935097 | 3/2007 |
| WO | WO 2007073810 | 7/2007 |
| WO | WO 2009067497 | 5/2009 |

* cited by examiner

MOVABLE HIGHLIGHT STRIP

CROSS-REFERENCE TO RELATED APPLICATION

This application claims priority to U.S. Provisional Application No. 61/563,352 filed Nov. 23, 2011. The entire disclosure of the above-referenced application is incorporated herein by reference in its entirety.

TECHNICAL FIELD

The present subject matter relates generally to a movable highlight strip that can be used, for example, with a notebook.

BACKGROUND

Known office supplies include a number of marking, flagging, and/or highlighting products. For example, tabbed partitions (e.g., dividers inserted between sets of pages with tabs protruding from the pages), such as those described in U.S. patent application No. 2003/0178837 and U.S. Pat. Nos. 1,614,838 and 4,970,984, provide a way for users to mark certain pages or sections for ease of reference. Flags with an even greater customizable placement, such as those described in U.S. Pat. Nos. 4,637,149, 4,898,115, and 5,283,091, provide a way for users to mark specific locations, lines, and/or words. The '091 patent describes the well known "sign here" flag, with a temporary adhesive for temporary use and subsequent removal.

Known office supplies also include translucent colored ink marking pens or "highlighters," which can mark existing indicia and the surrounding area with a colored coating, leaving the indicia legible and emphasized. Highlighters are very common office tools, but suffer from a number of drawbacks, such as seepage to the other side of a page and/or onto the next page. Highlighter pens are also permanent, which can be a desired attribute in some contexts, but is often another drawback. U.S. Pat. No. 4,175,777 discloses transparent colored sheets that can be affixed to cover subject matter desired to be marked or highlighted and extend to the margin of the page to be visible when the book is closed. The strips in this patent are provided individually, each on a release backing of a larger size.

It is desirable to provide an improved highlighter arrangement.

SUMMARY

A movable highlighting system that can include a base portion having a first surface that includes: a principal area of at least 80% of the base portion; and a marginal area. The system can include a binding or fastening member configured for holding a stack of paper on the principal area, and a supply of stickers in the marginal area. The stickers can include an adhesive configured to adhere to the paper in the stack. The stickers can include a plurality of highlighter strips that have a uniform translucent color configured for legibly highlighting indicia on the paper when adhered thereover. The adhesive can be disposed on a center portion of each strip, with one or both longitudinal ends of the strip being free of adhesive for permitting the end to be lifted from an adjacent sticker in the supply to which it is adhered.

The adhesive stickers can be stacked and releasably adhered to each other in the marginal area, which can be located on a side opposite the binding member. The base portion can be made from a cardboard sheet affixed to the stack by the binding portion that includes a binding on an upper edge. The paper can include marking areas, and can be ruled (e.g., with guidelines) of any number of standard or non-standard spacings. Each highlighter strip can be the same or proportional size of the rule spacing.

The base can include an attached flap, which can act as a bookmark or divider, and can include a plurality of the highlighter strips attached. The strips can also be configured in a roll, e.g., a dispensing roll, configured to dispense strips one at a time.

BRIEF DESCRIPTION OF DRAWINGS

The drawing figures depict one or more implementations in accord with the present concepts, by way of example only, not by way of limitations, In the figures, like reference numerals refer to the same or similar elements.

DETAILED DESCRIPTION OF PREFERRED EMBODIMENTS

Figure 1:
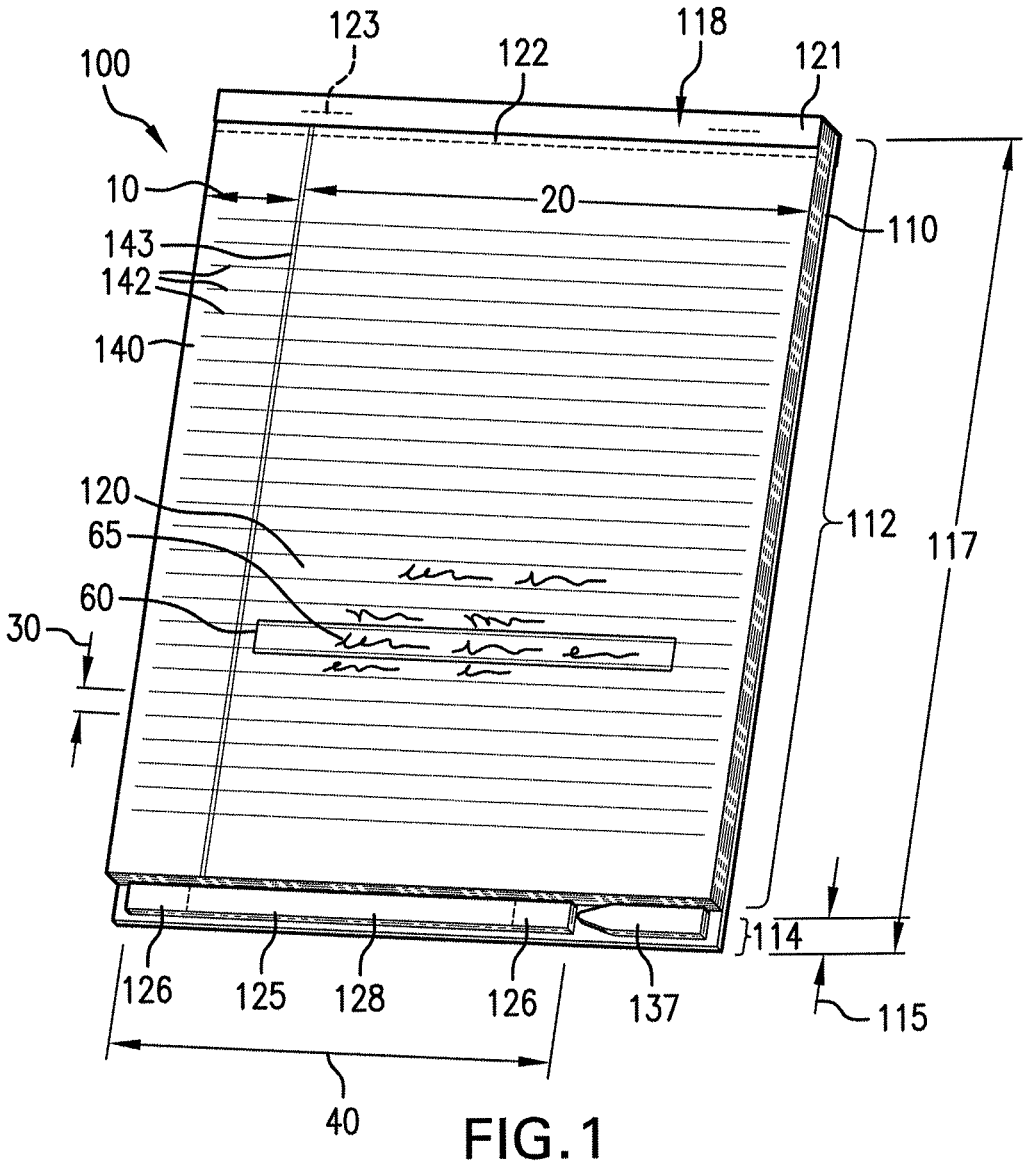
FIG. 1 is a view of a notepad with included highlighter strips, according to an exemplary embodiment of the present disclosure.

Exemplary embodiment can include various devices designed for receiving writing, such as a notepad, journal, or three-ring binder, etc. Referring to FIG. 1, an exemplary embodiment is illustrated as a notepad 100, including a base portion 110, such as the cardboard backing of the notepad 100. Base portion 110 can include a principle area 112, and a marginal area 114. These may be uniform portions of base portion 110, or may be divided, e.g., by different material, appearance, texture, etc. Marginal area 114 is preferably smaller and longitudinally shorter than principle area 112, and more preferably marginal area 114 will have up to about 20% of the area of base portion 110 and/or have a length 115 of up to about 20% of the length 117 of the base portion 110, and in other embodiments below about 10%, 5%, or 3%. Preferably, the marginal area 114 will have at least about 3% of the area of base portion 110 and/or have a length 115 of at least about 3% of the length 117 of the base portion 110. Marginal area 114 can be in any location, preferably on an edge, more preferably on an edge without binding (e.g., 118), and more preferably on an edge opposite a binding.

Figure 2:
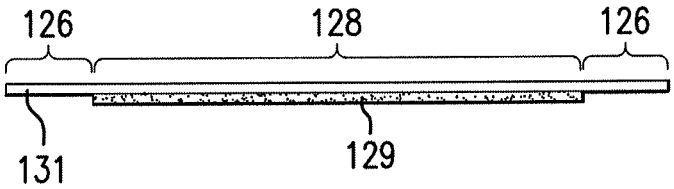
FIG. 2 is a side view of a single highlighter strip.

The exemplary notepad 100 of the exemplary embodiment illustrated in FIG. 1, can include a binding member, such as exemplary binding 118. This binding member 118 can be configured to hold a stack of paper 120 on the principle area 112, and typically is provided as a notepad binding arrangement, which can include glue, staples, thread, clamps, etc., or any. combination of suitable binding arrangements. The binding 118 preferably has an end cover layer 121 that is wrapped around the top and longitudinal edge of the stack 120 and bottom of the base portion 110 to cover the longitudinal end portion of the notepad 100 and the staples 123 or other binding components. In this way, base portion 110 can include a common dimension (e.g., width) as paper 120, while having a larger dimension (e.g., length) exposing marginal area 114. The exemplary embodiment shown in FIG. 1, e.g., as a notepad, can include sheets of paper 120 permanently bound by staples 123. Paper 120 can be permanently fixed to backing 110, or can include a perforation line 122, which can allow pages to be removed from the fixed binding 118. Whether fully attached or attached via a weakened perforation line 122, pages can be flipped over the binding to access subsequent pages without removing previous pages (e.g., as shown in FIG. 2).

The exemplary embodiment illustrated in FIG. 1, can include a supply of stickers 125,137 in the marginal area 114. These stickers 125 can include an adhesive configured to form a releasable or permanent bond with paper in the stack 120. The stickers 125 can be in any number of shapes, including the illustrated strip shape, and may be referred to in this and other exemplary embodiments as stickers or strips 125. The adhesive can be included as a layer over part or all of each sticker 125. FIG. 2 illustrates stickers 125 with an adhesive 129 provided on the underside of each sticker in a middle area 128 thereof, e.g., spanning between two end areas 126, which are free of adhesive, for example to facilitate grabbing and removing of a sticker from either lateral side thereof. Any of the exemplary strips can include adhesive in any area, unless otherwise specified for those specific embodiments. For example, FIG. 2 illustrates an adhesive over a central portion 128, which generally covers a centered portion of some fractional length, but could easily be included off-center (e.g., over portion 128 and the right end 126, but not the left end 126, etc. and vice versa), be included in non-continuous patches/sections, in patterns, or other partially covered arrangements. The adhesive region of sticker 125 can include any minimum area of adhesion, such as 1% of the overall area, but preferably can include over 50% of the area. The one or more adhesive free ends 126 can together or individually include any proportion of the total area (e.g., 1%), but preferably include about 10 to 20 percent each, or about 15% each. Thus, the adhesive to adhesive-free ratio can be any relative ratio, including about 9:1, 8:1, 7:1, 6:1, half-and-half or any ratio there between. These ratios can refer to the area of a single side, and the other side of strip 125 can preferably be free of adhesive on all or most of the surface, preferably all of the upper surface is free of adhesive.

In FIG. 1, the lateral edges of the adhesive in middle area 128 is shown with hidden lines. The stickers 125 in the supply shown are releasably adhered to each other, to remain in a stack, and the bottom sticker 125 is adhered, preferably releasably to the base portion 110. The base portion 110 can be provided with a release layer. The release layer can include wax, plastic, or any other material cooperatively selected to form a releasable bond with adhesive layer 129. A release layer can be affixed to a substrate, sprayed onto the substrate, or be integrally formed from the material of the substrate.

FIG. 1 also illustrates strips 125 as including attached flags 137. Each flag 137 can be translucent like strip 125, discussed below, or opaque. Whether translucent or opaque, the flag 137 can be the same or different color as strip 125. Flag 137 can be detachable or permanently connected. Further, flag 137 can include an adhesive like central portion 128, or be free of adhesive like end portion 126. The exemplary strip of FIG. 1 can be configured to be affixed at a page edge, such that flag 137 remains off the edge to act as an outside marker of a highlighted section, visible when the marked section is otherwise covered (e.g., the notepad/book is closed). In other exemplary embodiments, all of strip can include a layer of adhesive, including central portion, end portion, and optional second end portion, while flag 137 facilitates removal and grabbing by being free or partially free of adhesive. Flag 137 can be configured to receive writing, e.g., on its outer surface. Flag 137 can include adhesive on all or part of its under surface, for highlighting or flagging additional sections of indicia (e.g., by being detached from strip 124).

Each of the stickers 125 can have a translucent color, such that when placed over indicia (e.g., 65), the indicia remains legible through the sticker and any included adhesive (as shown by sticker 60). The translucent color is preferably uniform so to have the appearance of highlighter ink when placed on the paper over writing. Alternatively, the color and shading of the stickers can be varied or patterned. Further, the translucent color can span the entire strip 125, or alternatively just the center portion 128, just the ends 126, or other combinations. Various colors or textures can be provided for each element or different parts of each sticker. Additionally, in the preferred embodiment, the stickers 125 are free of any printing or markings, such as lines or preprinted words, so that they resemble a line of highlighting when stuck to the paper, although alternative embodiments can have printed matter thereon for other purposes. Not only can the indicia remain legible, but the translucent color can highlight that indicia, flagging it among other indicia.

FIG. 1 also illustrates exemplary page 120 that includes ruling or guidelines. The ruling (e.g., the guidelines) can include the evenly spaced lines 142, and/or margin line 143, which may be printed on either side or both sides. The ruling can also include evenly spaced vertical lines (not shown), e.g., as in common graph paper. The ruling can be configured at any number of distances 30. For example, common spacing for rules 142 include: wide ruled (or legal ruled) as 11/32 inches (8.7 mm), medium ruled (or college ruled) as 9/32 inches (7.1 mm), or narrow ruled as ¼ in (6.35 mm). Any other spacing dimensions 30 are also possible. Also, the distance 10 from an edge of the paper 140 and margin line 143 can be any number of widths, including a common 1¼ in (31.75 mm). The main writing area (e.g., outside the margin or between dual margins), can have a distance 20, which can include any number of widths, including standard widths (e.g., letter, legal, A4) less an associated margin or pair of margins.

Figure 3:
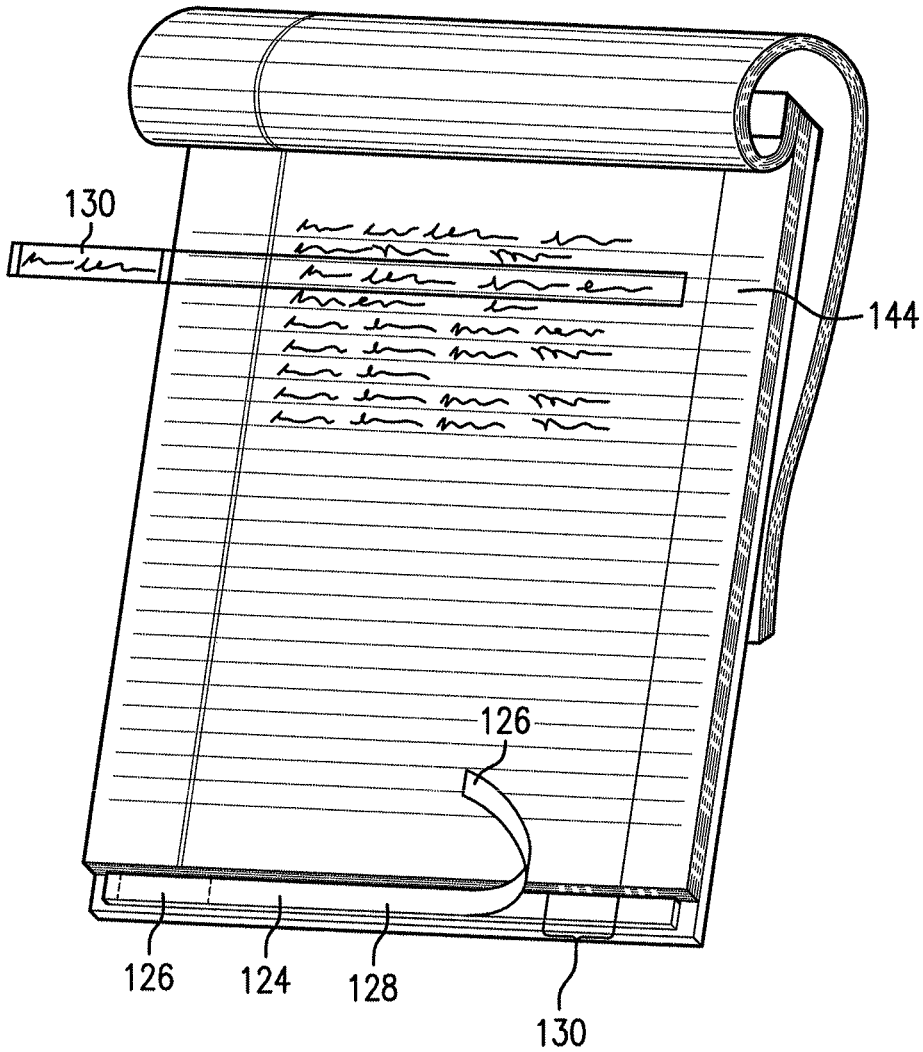
FIG. 3 is another notepad with pages flipped and strips affixed.

FIG. 3 shows another exemplary embodiment of the present invention, similar to FIG. 1, with right end 126 being used to peal top strip 124 from the stack of stickers. Each strip 124 can include two ends 126 without adhesive or only one end 126 (not shown) without adhesive. Preferably, a central area 128 of each strip 124 includes an adhesive layer. The bottom most strip 124 of the stack can be adhered to the marginal area 114, while each other strip 124 is releasably adhered to the back of the previous strip 124 to form the stack. Each strip can also include a tab area 130, which may be part of the end 126. Tab area 130 can be configured to accept indicia (e.g., by a common ink pen or common pencil). This can allow a user to affix a strip off the edge of the paper (e.g., as illustrated), to provide an external tab or flag marker. Additionally or alternatively, strips can still be affixed fully within the edges of the paper, and tab area 130 can act as a customizable area on highlight strip 124. FIG. 3 illustrates exemplary stickers 124 without a flag portion 137, and about the same width or slightly smaller than the illustrated papers.

The exemplary highlight strips, e.g., 124 or 125, can be configured in a number of lengths and heights. For example, highlighter strips can be at least three times longer than they are high. They may have a height proportional to a standard line spacing (e.g., 120%, 110%, 100%, or 90% of 11/32 inch line spacing, or of 1/4 inch line spacing). Highlighter strips can have a length proportional to page width dimensions. For example, standard letter sized pages can be about 8.5 inches by 11 inches, with a first margin line at about 1.25 inches from the left edge, and with an optional second margin line at about 1.25 inches from the right edge, e.g., 144. The highlighter strip 124 can then be proportioned with respect to one of these values, e.g., a full page width of about 8.5 inches, a width outside the margin of about 7.25 inches, or a width outside two margins of about 6 inches. Highlighter strips 124 and/or 125 can be longer than a page width, e.g., the central portion 128 can be about 8.5 inches or central portion 128 and a tab 126 can be about 8.5 inches, while another tab 126 can extend beyond the 8.5 inch page width. Highlighter strips 124 can also be some fractional portion of these values, e.g., 120%, 110%, 100%, or 90% of 8.5 inches, or of 6 inches, etc.

Figure 4:
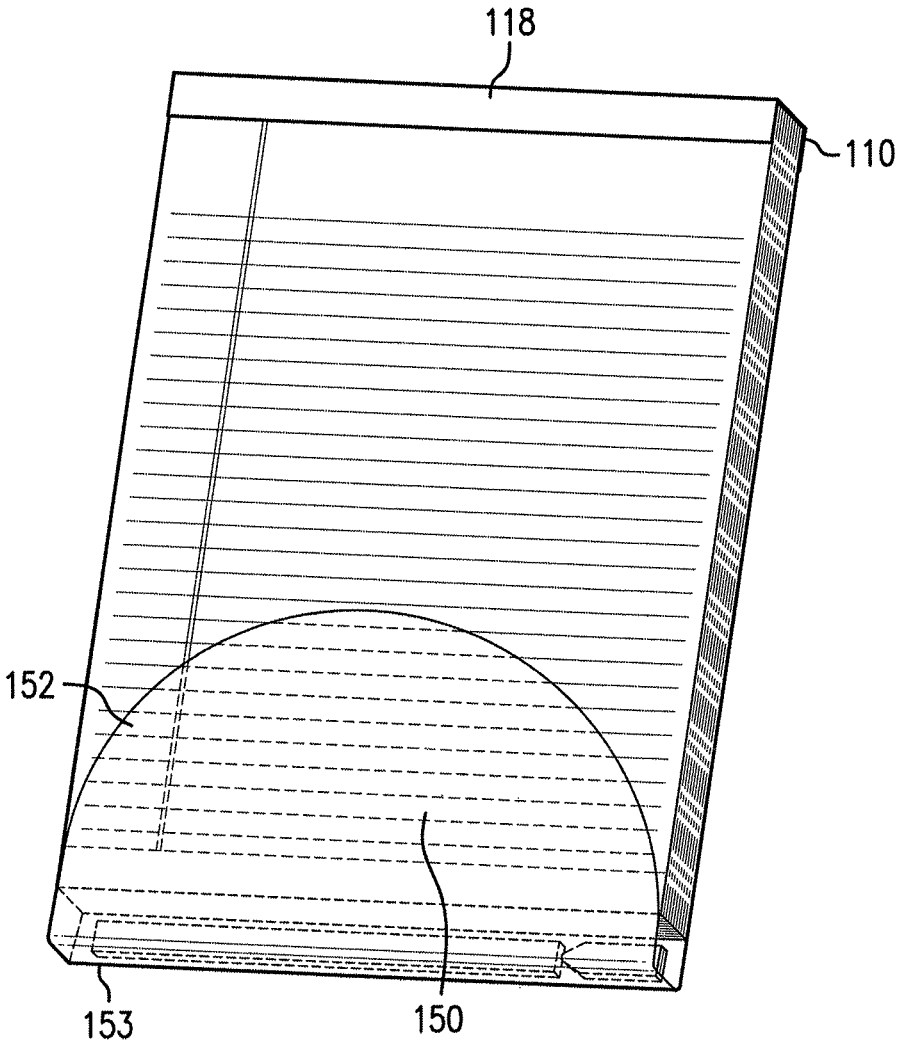
FIG. 4 is another notepad with a flap affixed to it, according to another exemplary embodiment of the present disclosure.
Figure 5:
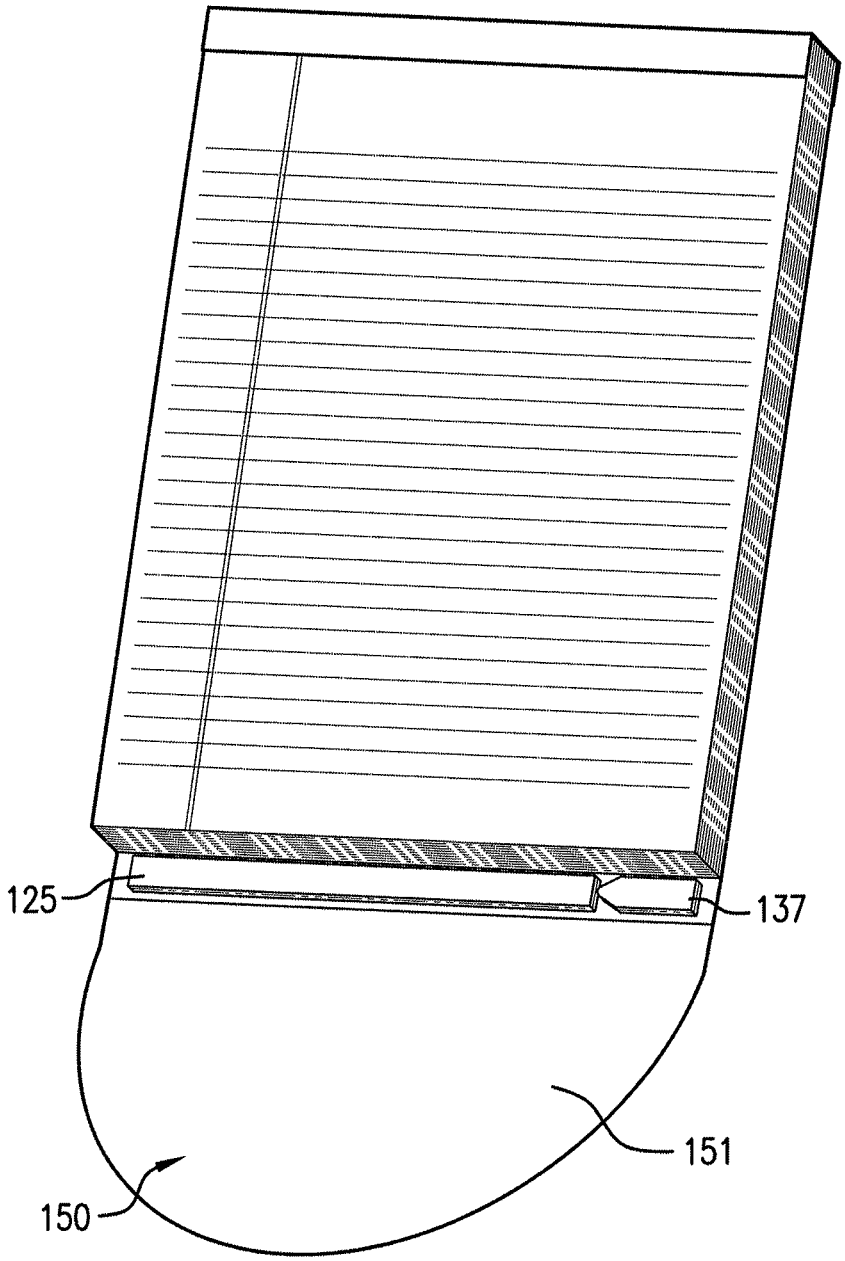
FIG. 5 is another view of FIG. 4, with the flap in an opened position.

FIG. 4 illustrates another exemplary embodiment, in which base portion 110 includes a flexible flap 150 extending from the bottom end (opposite the binding 118) of the base portion 110. Flap 150 can extend as a continuation of the end of the base portion 110, e.g., from the end of marginal area 114, or at a hinge 153, such as a living hinge. Flap 150 can alternatively extend from a lateral side of the base 110, and in a certain embodiment from the binding 118 side, and will preferably be connected to a side without the binding member 118, and more preferably to the side opposite binding member 118 (e.g., the bottom side, as illustrated).

Figure 6:
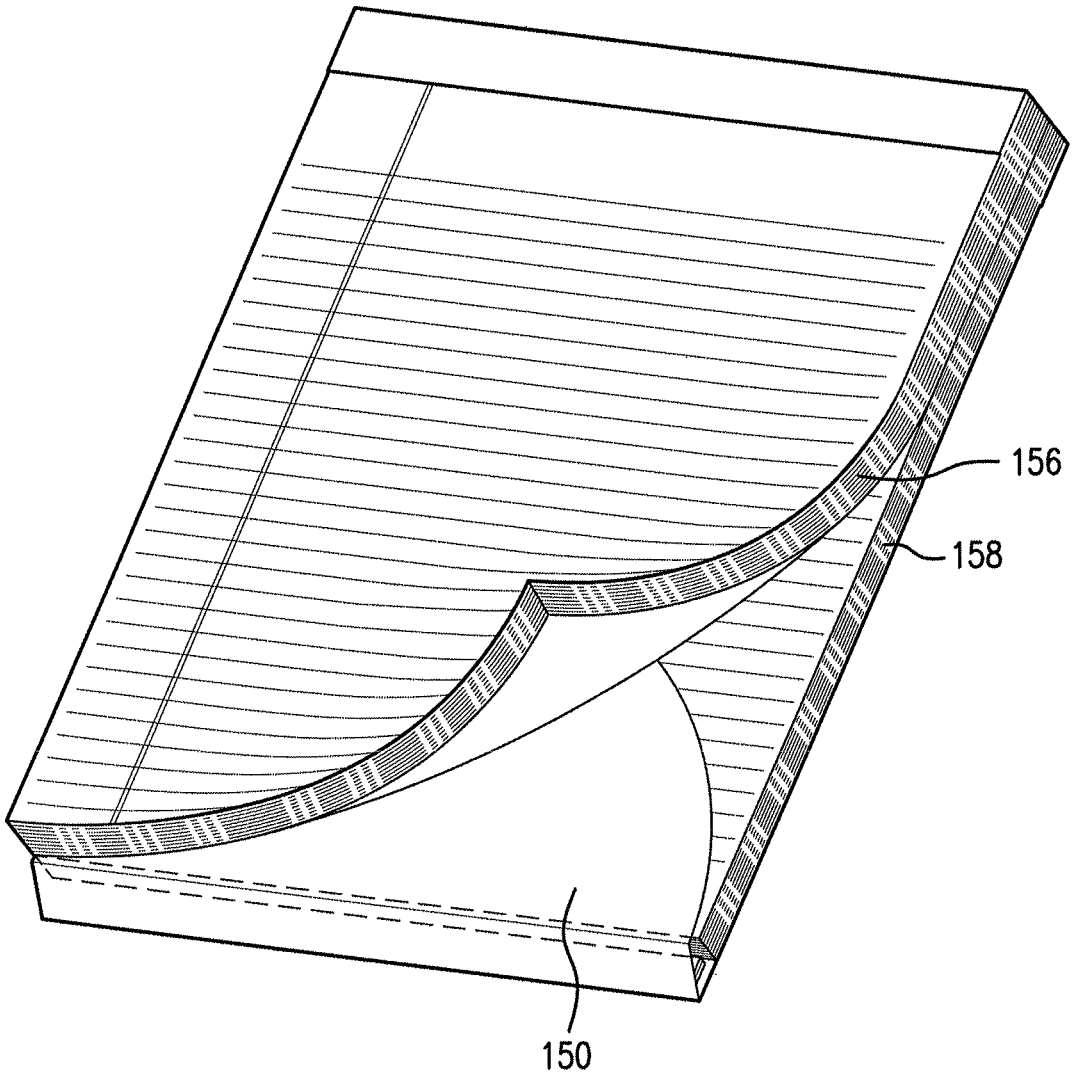
FIG. 6 is another view of FIGS. 4 and 5, with the flap positioned as a page divider.

The supply stack of highlighter strips 125,137 can then be included on the marginal area 114 and covered by the flap 150 when folded over the stack of sheets 120. In an alternative embodiment, the stickers 125 can be positioned on the inner side 151 of the flap 150, such as in an embodiment that does not include a marginal area of the base portion. This flap 150 can be used to hold the bottom of papers 120 (e.g., as illustrated in FIG. 4), and/or can be used as a bookmark or divider of two sections of papers 120 (e.g., as shown in FIG. 6, partitioning paper group 158 and group 156). This flap can be configured as a markable surface (e.g., dry erase, cardboard, paper, etc.), and/or a durable surface (e.g., plastic, metal, etc.). Hinge 153 can be removable so that flap 150 can be detached, either permanently, temporarily, or interchangeably. This flap 150 can be transparent or translucent, and in at least one embodiment can be used without the stickers 125.

Figure 7:
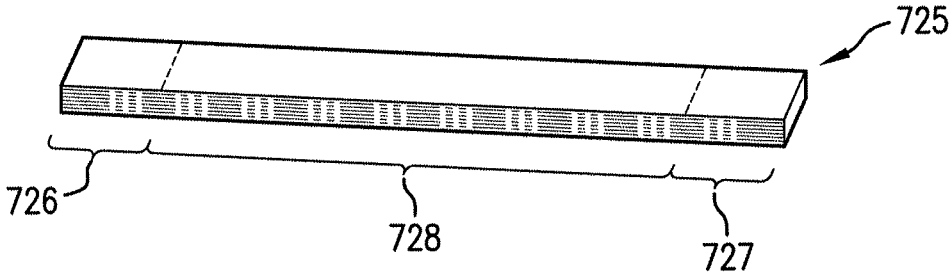
FIG. 7 is a stack of highlighter strips, according to another exemplary embodiment of the present disclosure.

FIG. 7 illustrates another exemplary embodiment, including an exemplary stack of highlighter strips 725. These strips can also include a central portion 728 with adhesive included, an end portion 726 without adhesive included, and an optional second end portion 727, with or without adhesive included. Highlighter stack 725 can be a stand alone set of highlighter strips, can be included on a base layer (e.g., a release coated substrate) (not shown), within a dispensing container (not shown), or as a refill set of highlighter strips, configured to be affixed to other exemplary embodiments. One or both sides can be free of adhesive. The adhesive-free ends 726,727 can be stacked in an alternative position so that when the top strip is lifted, the strips are lifted in a zigzag patterns, which can be useful when used with a container to draw up the next strip with the top one is removed.

Figure 8:
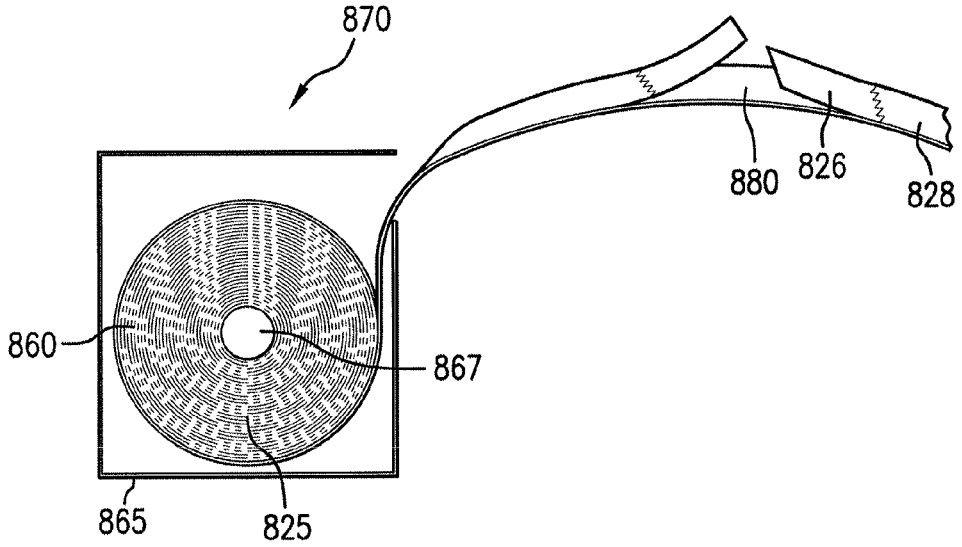
FIG. 8 is a roll of highlighter strips, according to another exemplary embodiment of the present disclosure.

FIG. 8 illustrates another exemplary embodiment, including a dispensing roll 860 of a plurality of highlighter strips 825, e.g., within a dispenser 865. The roll 860 can include a backing/release carrier tape 880 on which the strips 825 are carried. The tape 880 can have perforations in the backing layer between strips for removing individual strips 828,826. Another detachment arrangement can include a tearable tape 880 to be torn by hand (e.g., a paper based backing with a release coating or layer for example).

In another exemplary embodiment, the roll 860 may rotate about an axis 867, and each strip 825 can be connected to the next strip, such that pulling on strip 825 can bring the next strip part of the way out of the dispenser 825. Each strip 825 can be affixed within the roll 860 to include at least some part of central portion 828 over (e.g., affixed to) the next strip's end portion 826 (e.g., a portion without adhesive), which can facilitate a first strip 828 at least partially removing a next strip from roll 860. The user can then manually separate the first strip from the remaining strips. The roll 860 can be configured to dispense the strips in one long connected string of affixed strips, or can be configured to automatically pull one strip off at a time.

Figure 9:
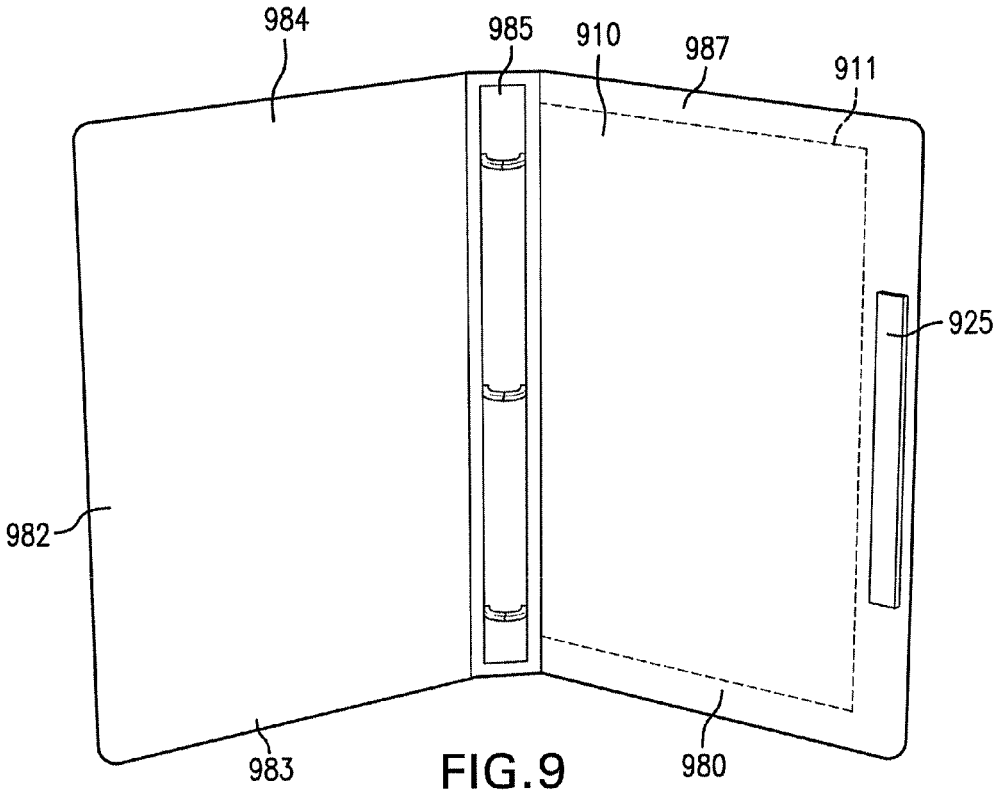
FIG. 9 is a ring-binder with included highlighter strips, according to another exemplary embodiment of the present disclosure.

The exemplary roll of strips 860 illustrated in FIG. 8 can be provided as a stand alone entity tape, or can be provided in conjunction with other entities, such as was described in previous embodiments. For example, dispensing entity 870 can be included on the back of notepad base portion 110 or on flap 150, FIG. 9 illustrates another exemplary embodiment where base portion 910 includes a cover of a binder (e.g., a three ring binder). Highlighter strip stack 925 can be included on base portion 910 at any number of locations, e.g., spots 980-985, or any other suitable location. These locations can also include a dispenser roll 870, or any other configuration of a plurality of highlighter strips. Dashed line 911 illustrates the possible profile of included sheets of paper, making each of spots 980-984 a marginal area. While a marginal area may be a preferable location for strips 925, the highlighter strips can be located anywhere else on the binder, including on the outside cover area.

Figure 10:
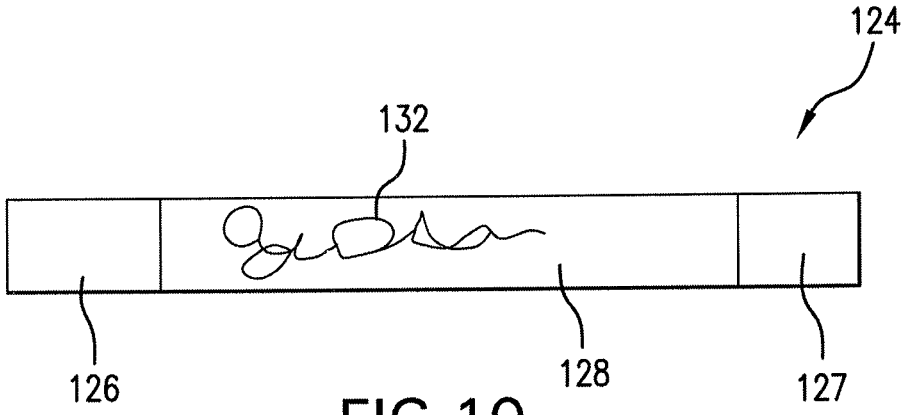
FIG. 10 is a single highlighter strip, according to another exemplary embodiment of the present disclosure.

FIG. 10 illustrates an exemplary embodiment of a single highlighter strip, including grabbing end 126, optional second end 127, and a central portion 128 (which can extend to include end 127 in embodiments with only one end 126) with a removable adhesive. The strip 128 and removable adhesive can be configured such that indicia 132 is legible beneath strip 124. The adhesive can cause a temporary, releasable, or permanent bond with various substrates. Initially, the adhesive can form a temporary or releasable bond with at least a first release layer (e.g., the back of another highlighter strip), and subsequently can form a temporary or permanent bond with a substrate (e.g., paper with indicia thereon). Preferably, the bond will remain releasable, allowing highlighter strips to be used, re-used, removed, or otherwise moved to different locations within a substrate or multiple substrates. Other implementations can allow for strips to form a permanent bond once applied to a second substrate (e.g., for applications where a user wants to ensure highlighting is not altered or undone).

All of the references specifically identified in the detailed description section of the present application are expressly incorporated herein in their entirety by reference thereto. The term "about," as used herein, should generally be understood to refer to both the corresponding number and a range of numbers. Moreover, all numerical ranges herein should be understood to include each whole integer within the range. Moreover, various adhesives and/or bonds are described as temporary and/or permanent. These can relate to a general relative strength between the two, whether the bond would cause structural damage if removed, whether the adhesive can be reused after a previous use, or any number of other relative strength distinctions between permanent, semi-permanent, temporary, and/or removable. In the case of paper envelopes, a permanent adhesion would typically remove a layer of paper along with the strip as it is pulled off. References to more permanent adhesion indicates a noticeably stronger adhesion that a temporary adhesion. Also, exemplary envelopes can be of any size, shape, and/or material, including standards sizes configured to receive one or more standard sized papers, e.g., letter, legal, A4, etc.

In exemplary embodiments described herein, indicia may be used to describe any number of markings, pre-printed text, hand-written text, graphics, images, symbols, or similar. Further, when legibility is discussed, legible can refer to being technically legible (e.g., able to be read), equally legible, and/or highly legible (e.g., near-equal, equal, or even of greater readability). Moreover, certain exemplary highlighter strips can be described as being configured to be placed over indicia while the indicia remains legible, which can include all suitable configurations of the highlighter strips, even if specialized configurations of the indicia would render that indicia illegible. For example, a highlighter strip of a certain color (e.g., yellow) can be configured to be placed over indicia while the indicia remains legible, if certain indicia-characteristics allow it to be legible (e.g., black colored indicia), even if certain other specific indicia-characteristics do not allow it to be legible (e.g., indicia of the exact or near same yellow color).

While illustrative embodiments of the invention are disclosed herein, it will be appreciated that numerous modifications and other embodiments may be devised by those skilled in the art. For example, the features for the various embodiments can be used in other embodiments. Therefore, it will be understood that the appended claims are intended to cover all such modifications and embodiments that come within the spirit and scope of the present invention.

What is claimed is:

1. A movable highlighting system, comprising:

a base portion having a first surface that includes:

a principal area of at least 80% of the base portion; and a marginal area;

a fastening member configured for holding a stack of paper on the principal area;

a supply of stickers in the marginal area, the stickers including an adhesive configured to adhere to the paper in the stack and including a plurality of highlighter strips that have a translucent color configured for legibly highlighting indicia on the paper when adhered thereover, wherein the adhesive is disposed on a center portion of each highlighter strip, with both longitudinal ends of the highlighter strip being free of adhesive for permitting either end to be lifted from an adjacent sticker in the supply to which it is adhered.

2. The system of claim 1, wherein the highlighter strips each has a uniform translucent color over the entire highlighter strip.

3. The system of claim 1, wherein the stickers are stacked and releasably adhered to each other in the marginal area.

4. The system of claim 1, wherein the adhesive is configured for releasable adhesion to paper.

5. The system of claim 1, further comprising:

the stack of paper, wherein the fastening member affixes the stack to the base in a notepad configuration.

6. The system of claim 5, wherein the base is made from a cardboard sheet affixed to the stack by the fastening member that includes a binding on an upper edge.

7. The system of claim 5, wherein the paper in the stack includes a blank area configured for marking indicia thereon.

8. The system of claim 7, wherein the blank area is ruled.

9. The system of claim 8, wherein the ruling includes a plurality of horizontal lines that are evenly spaced apart between ¼ and ½ of an inch, and wherein the stickers have a height that is less than about 120% of the spacing.

10. The system of claim 9, wherein the spacing is between 9/32 and 11/32 of an inch, and wherein the stickers have a height that is about 100% of the spacing.

11. The system of claim 8, wherein the ruling defines a margin of the paper in the stack separating a paper margin area and a writing area, wherein the highlighter strips have a width that is less than the width of the writing area.

12. The system of claim 5, wherein the paper in the stack has a width, and the highlighter strips have a width that is less than about 90% of the width of the paper.

13. The system of claim 1, wherein the marginal area is located on a side opposite the fastening member.

14. The system of claim 1, wherein the base portion includes a flap portion hingedly connected to a side without the fastening member, and wherein the plurality of highlighter strips is affixed to the flap.

15. A movable highlighting system, comprising:

a base portion having a first surface that includes:

a principal area of at least 80% of the base portion; and a marginal area;

a fastening member configured for holding a stack of paper on the principal area;

a supply of stickers in the marginal area, the stickers including an adhesive configured to adhere to the paper in the stack and including a plurality of highlighter strips, wherein the base portion includes a flap portion hingedly connected to a side without the fastening member with the plurality of highlighter strips affixed to the flap, wherein the hinge includes an inner side substantially covered when the flap is disposed between pages, and an outer side substantially exposed when the divider flap is disposed between pages, and wherein the highlighter strips are affixed to the divider flap on the side continuous with the inner side.

16. The system of claim 15, wherein the adhesive is disposed on a center portion of each strip, with a longitudinal end of the strip being free of adhesive for permitting the end to be lifted from an adjacent sticker in the supply to which it is adhered.

17. The system of claim 16, wherein both longitudinal ends are free of adhesive for permitting either end to be lifted from the adjacent sticker in the supply to which it is adhered.

18. The system of claim 15, wherein the highlighter strips have a translucent color configured for legibly highlighting indicia on the paper when adhered thereover.

19. The system of claim 15, wherein both longitudinal ends are free of adhesive for permitting either end to be lifted from the adjacent sticker in the supply to which it is adhered.

20. A movable highlighting system, comprising:

a base portion having a first surface that includes:

a principal area of at least 80% of the base portion; and a marginal area;

a fastening member configured for holding a stack of paper on the principal area;

a supply of stickers in the marginal area, the stickers including an adhesive configured to adhere to the paper in the stack and including a plurality of highlighter strips, wherein the base portion includes a flap portion hingedly connected to a side without the fastening member, with the plurality of highlighter strips affixed to the flap, wherein the highlighter strips are affixed to an area of the divider flap substantially parallel to the hinge and near the hinge.

21. The system of claim 20, wherein the adhesive is disposed on a center portion of each strip, with a longitudinal end of the strip being free of adhesive for permitting the end to be lifted from an adjacent sticker in the supply to which it is adhered.

22. The system of claim 20, wherein the highlighter strips have a translucent color configured for legibly highlighting indicia on the paper when adhered thereover.

* * * * *